US009509034B2

(12) United States Patent
Xue et al.

(10) Patent No.: US 9,509,034 B2
(45) Date of Patent: Nov. 29, 2016

(54) N-WAY COAXIAL WAVEGUIDE POWER DIVIDER/COMBINER

(71) Applicant: City University of Hong Kong, Kowloon (HK)

(72) Inventors: Quan Xue, New Territories (HK); Peng Wu, Kowloon (HK)

(73) Assignee: CITY UNIVERSITY OF HONG KONG, Kowloon (HK)

( * ) Notice: Subject to any disclaimer, the term of this patent is extended or adjusted under 35 U.S.C. 154(b) by 67 days.

(21) Appl. No.: 14/543,854

(22) Filed: Nov. 17, 2014

(65) Prior Publication Data

US 2016/0141742 A1 May 19, 2016

(51) Int. Cl.
*H01P 5/12* (2006.01)

(52) U.S. Cl.
CPC ..... *H01P 5/12* (2013.01)

(58) Field of Classification Search
CPC ..... H01P 5/16; H01P 11/002; H01P 11/003; H01P 11/005
USPC ..... 333/125–127
See application file for complete search history.

(56) References Cited

U.S. PATENT DOCUMENTS 4,780,685 A * 10/1988 Ferguson ..... H03F 1/526 330/124 D
6,242,984 B1 * 6/2001 Stones ..... H01P 5/107 330/295
7,215,220 B1 5/2007 Jia et al.
7,227,428 B2 * 6/2007 Fukunaga ..... H01P 5/107 333/21 R
7,312,673 B2 12/2007 Wu et al.

OTHER PUBLICATIONS

Jia, et al., "Broad-band high-power amplifier using spatial power-combining technique," IEEE Trans. Microw. Theory Tech., vol. 51, No. 12, pp. 2469-2475, Dec. 2003.
Song, et al., "Broadband radial waveguide power amplifier using a spatial power combining technique," IET Microw. Antennas Propag., vol. 3, No. 8, pp. 1179-1185, 2009.
Xue, et al., "China: Power combiners/dividers," IEEE Microwave Magazine, vol. 12,No. 3,pp. 96-106, 2011.
Song, et al., "Ultra-Wide band Ring-Cavity Multiple-Way Parallel Power Divider," I IEEE Transactions on Industrial Electronics, vol. 60. No. 10, pp. 4737-4745, 2013.
(Continued)

*Primary Examiner* — Robert Pascal
*Assistant Examiner* — Kimberly Glenn
(74) *Attorney, Agent, or Firm* — Amin, Turocy & Watson, LLP

(57) ABSTRACT

A low loss and compact power divider/combiner is provided for high power efficiency. The power divider/combiner can be an N-way coaxial-waveguide cavity power divider/combiner with good characteristics of low loss and compact size. The power divider/combiner can be comprised of a coaxial common port, a radial-waveguide cavity, and N-way probe outputs. In various embodiments, the power divider/combiner can have a plurality of probe outputs that are equally spaced radially around an axis on which the coaxial common port is located. The radial-waveguide cavity and N-way probe outputs can be fabricated on a substrate board using printed circuit technology. In addition, the power divider/combiner can have reversed probe outputs which provide for 180 degree out of phase outputs between the probe outputs.

20 Claims, 12 Drawing Sheets

(56) References Cited

OTHER PUBLICATIONS

Xue, et al., "Ultra-wideband coaxial-waveguide power divider with flat group delay response," Electronics Letters, vol. 46, No. 17, pp. 1236-1237, 2010.
Amjadi, et al., "Design of a broadband eight-way coaxial waveguide power combiner," IEEE Trans. Microw. Theory Tech., vol. 60, No. 1, pp. 39-45, Jan. 2012.
Shan, et al., "A Suspended-Substrate Ku-Band Symmetric Radial Power Combiner," IEEE Microw. Wireless Compon. Lett., vol. 21, No. 12, pp. 652-654, Dec. 2011.
Villiers, et al. "Design of Conical Transmission Line Power Combiners Using Tapered Line Matching Sections," IEEE Trans. Microw. Theory Tech., vol. 56, No. 6, pp. 1478-1484, Jun. 2008, Last accessed Jan. 27, 2015.
Mestezky, et al., "N-way unequal power divider with balanced excitation," European Conf. on Antennas and Propag., pp. 1816-1819,2013, Last accessed Jan. 27, 2015.
Fathy, et al., "A simplified design approach for radial power combiners," IEEE Trans. Microw. Theory Tech., vol. 54, No. 1, pp. 247-255, 2006.
Hong, et al., "Differential radial power combiner using substrate integrated waveguide," Electronics Letters, vol. 46, No. 24, pp. 1607-1608, 2010.
Song, et al., "Eight-way substrate integrated waveguide power divider with low insertion loss," IEEE Trans. Microw. Theory Tech., vol. 56, No. 6, pp. 1473-1477, Jun. 2008.
Deslandes, et al., "Analysis and design of current probe transition from grounded coplanar to substrate integrated rectangular waveguides," IEEE Trans. Microw. Theory Tech., vol. 53, No. 8, pp. 2487-2494, Aug. 2005.

* cited by examiner

900

920

1000

1020

N-WAY COAXIAL WAVEGUIDE POWER DIVIDER/COMBINER

TECHNICAL FIELD

This disclosure relates generally to a coaxial waveguide power divider/combiner that transfers power between a plurality of radio-frequency transmission lines.

BACKGROUND

Broadband microwave and millimeter-wave, high-power, solid-state amplifiers with high efficiency have been used widely in many systems such as satellite communication systems, commercial communication, and radar transmitters/receivers. The output power from an individual solid state device is often not high enough to be efficiently transmitted at those frequencies, and therefore power is combined from multiple devices to obtain sufficient power levels. In some circumstances, power also needs to be split efficiently, such as in array-antenna systems where the transmitted electromagnetic wave power is split and fed to each antenna radiation cell by power divider network.

SUMMARY

The following presents a simplified summary of the specification in order to provide a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later. It will also be appreciated that the detailed description may include additional or alternative embodiments beyond those described in this summary.

In various non-limiting embodiments, an apparatus and methods are provided to a coaxial waveguide power divider/combiner that transfers power between a plurality of radio-frequency transmission lines. In an example embodiment, a power divider/combiner comprises a dielectric substrate between an upper metal sheet and a lower metal sheet. The power divider/combiner can also include metal connectors that link the upper metal sheet and the lower metal sheet forming a cavity within the dielectric substrate with ports formed in the cavity, wherein the ports are substantially radially symmetrical around a circumference of the cavity. The power divider/combiner can also include a coaxial common port that is formed in an axis of the cavity, perpendicular to the ports.

In another embodiment, a method for splitting power comprises receiving a first transmission from a coaxial transmission line at a coaxial common port. The method can also comprise transferring radio frequency energy associated with the first transmission into a dielectric cavity formed with an upper layer and a lower layer formed by a first metal layer and a second metal layer respectively, with an upper metal sheet and a lower metal sheet and a lateral boundary of the cavity formed by metal connectors. The method can also include transmitting transmissions through one or more ports spaced radially symmetrically around the cavity, wherein the transmissions have powers that are substantially equal to each other, and are based on a function of a number of the ports.

In another example embodiment, a method for fabricating a power divider/combiner comprises printing microstrips onto a dielectric substrate, the microstrips forming ports arranged radially around an axis of the dielectric substrate. The method can also include forming a cavity in the dielectric substrate by placing a first metal sheet above the dielectric substrate and a second metal sheet below the dielectric substrate and connecting the first metal sheet and the second metal sheet with metal connectors through the dielectric substrate, wherein the metal connectors form the lateral bounds of the cavity. The method can also include forming a coaxial common port at the axis of the cavity.

The following description and the annexed drawings set forth certain illustrative aspects of the specification. These aspects are indicative, however, of but a few of the various ways in which the principles of the specification may be employed. Other novel features of the specification will become apparent from the following detailed description of the specification when considered in conjunction with the drawings.

BRIEF DESCRIPTION OF THE DRAWINGS

Non-limiting and non-exhaustive embodiments of the subject disclosure are described with reference to the following figures, wherein like reference numerals refer to like parts throughout the various views unless otherwise specified.

DETAILED DESCRIPTION

In the following description, numerous specific details are set forth to provide a thorough understanding of various embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

As an overview of the various embodiments presented herein, a low loss and compact power divider/combiner is provided for high power efficiency. The power divider/combiner can be an N-way coaxial-waveguide cavity power divider/combiner with good characteristics of low loss and compact size. It consists of a coaxial common port, a radial-waveguide cavity, and N-way probe outputs. In various embodiments, the power divider/combiner can have a plurality of probe outputs that are spaced symmetrically radially around an axis on which the coaxial common port is located. The radial-waveguide cavity and N-way probe outputs can be fabricated on a substrate board using printed circuit technology. In addition, the power divider/combiner can have reversed probe output which provide for 180 degree out of phase outputs between the probe outputs.

The cavity and N-way probe outputs (are designed on a substrate board and then they are connected to the common port 1# of a coaxial line. The cavity is formed by the metallic posts or rectangular metallic slots through the substrate and the wide walls of the waveguide cavity are formed by the top and bottom substrate metal sheets. The current probe is employed and inserted in the cavity to transfer power between the cavity and the outside transmission line. The peripheral transmission lines are arranged around the cavity periphery at equally spaced locations. Owing to its symmetry, the power at each of the transmission lines is related to the power at the common port in proportion to the number of outside transmission lines.

Figure 1A:
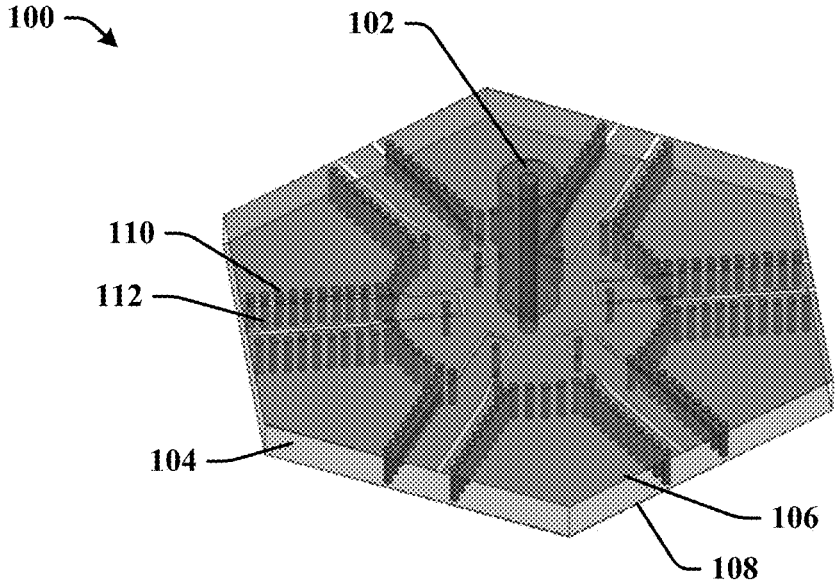
FIG. 1A illustrates an example, non-limiting embodiment of a power divider/combiner in accordance with the subject disclosure.

Turning now to FIG. 1A, illustrated is an example, non-limiting embodiment of a power divider/combiner 100 in accordance with the subject disclosure. The power divider/combiner 100 shown in FIG. 1A is a 6-way power divider/combiner that receives power from a coaxial common port 102 and splits the power substantially equally between the 6 ports (e.g., port 112).

In an embodiment, the power divider/combiner 100 can comprise a dielectric substrate 104. The dielectric substrate 104 can form an integrated circuit on which metallic microstrips are printed to form probe outputs that function as waveguides, the dielectric substrate 104 forming a radial waveguide cavity. In an embodiment, the dielectric substrate 104 can be formed from a substrate board using printed circuit technology. In an embodiment, the dielectric substrate 104 can have a dielectric constant between 2.2 and 2.4, and have a thickness between about 1.5 mm and about 1.7 mm, and have a dielectric loss tangent between about 0.001 and 0.002.

In an embodiment, the power divider/combiner 100 can include more than 6 ports or fewer than 6 ports. In an embodiment, the ports can be equally spaced radially around the axis formed by the coaxial common port 102. In that case, the ports can have radial symmetry around the axis. In other embodiments, the ports can be unequally spaced around the power divider/combiner 100 with one or more sides having a greater density or lower density of ports.

In an embodiment, the dielectric substrate 104 can have a metal sheet 106 above the dielectric substrate 104 and another metal sheet 108 below the dielectric substrate 104. It is to be appreciated that in other some embodiments, the metal sheets 106 and 108 can be made out of partially metallic or otherwise non metallic conductors. Connecting the metal sheets 106 and 108 can be a plurality of metal posts or metallic slots 110 that connect the metal sheets 106 and 108 through the dielectric substrate 104. It is to be appreciated that in other embodiments, metal wires, or other conducting materials can be used to connect the metal sheets 106 and 108.

The metal posts 110 and the metal sheets 106 and 108 form the bounds of the cavity within which pass the microwave and/or millimeter wave transmissions. In the embodiment shown in FIG. 1A, the metal posts 110 form six spokes around the center of the power divider and combiner 100. Within the spokes, microstrips can be printed (shown in more detail in FIG. 1B) that form the probe inputs/outputs through which the transmissions are passed.

In an embodiment, a transmission entering via a transmission line linked to the coaxial common port 102 gets injected into the cavity formed in the power divider/combiner 100. The transmission couples to the microstrip waveguides and is passed through the six probe output ports. In an embodiment, the transmission that enters via coaxial common port 102 couples equally to the probe outputs and thus the six output transmissions are substantially equal to each other. The power output can be a based on a function of the number of probe outputs, the input power and the amount of loss sustained in the splitting of the power. The losses can be reflective losses that are based on the frequency ($S_{11}$—reflection coefficient) or transmission losses that are also based on the frequency ($S_{N1}$—forward gain). These losses collectively form the insertion loss, which can change depending on the frequency being transmitted through the power divider/combiner 100.

The phrase "substantially equal" as used herein is to refer to a relative measure that is equal to within a margin of error that is considered acceptable based on predefined design parameters. Slight variances in position, shape, material density, etc, can cause variations in the output transmissions such that the power coupled is not exactly equal, but is considered practically equal for the purposes of the invention.

In another embodiment, one or more transmissions can enter through one or more of the probe output/inputs 112 and be combined with the other transmissions which then collectively couple to the coaxial common port 102 and are emitted as a combined transmission.

Figure 1B:
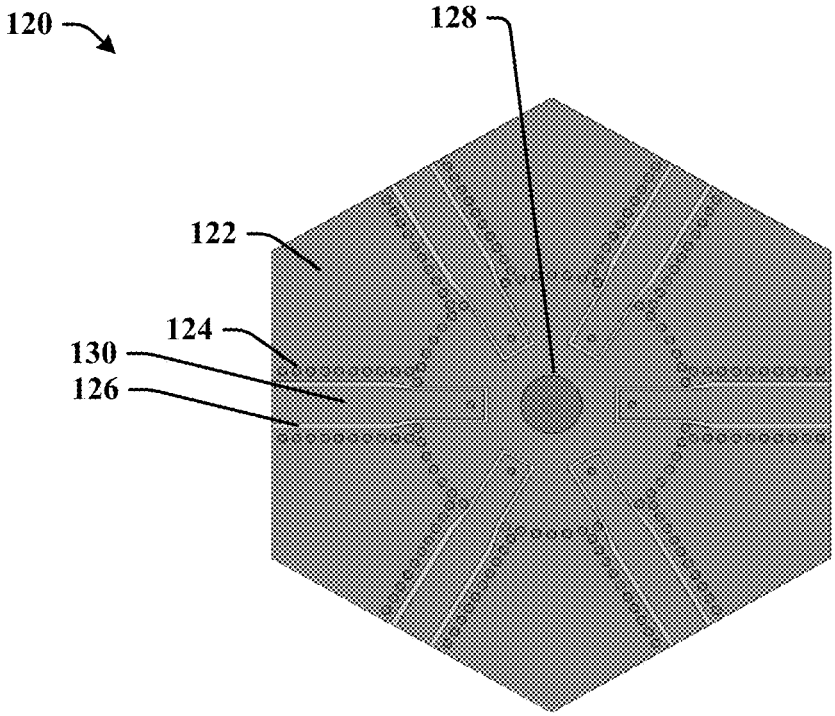
FIG. 1B illustrates an example, non-limiting embodiment of a power divider/combiner in accordance with the subject disclosure.

Turning now to FIG. 1B, illustrated is an example, non-limiting embodiment of a power divider/combiner 120 in accordance with the subject disclosure. FIG. 1B is a top down view of the same or a similar power divider/combiner shown in FIG. 1A. Power divider/combiner 120 includes a dielectric substrate 122 that is bounded by top and bottom metal sheets (not shown) and have metal posts, wires, and/or connections 124 formed between the metal sheets. These metal connections and the metal sheets form a cavity through which electromagnetic energy is split and/or combined. Printed microstrips (e.g., printed microstrip 126) form probe outputs (e.g, probe output 130) to which transmissions couple when the power divider and combiner 120 is in operation.

In an embodiment, a transmission received via the coaxial common port 128 couples equally to the six probe output, and is transmitted out to transmission lines coupled to the probe outputs with a concomitant decrease in power that is based on a function of the number of probe outputs, in this case, six.

Figure 2:
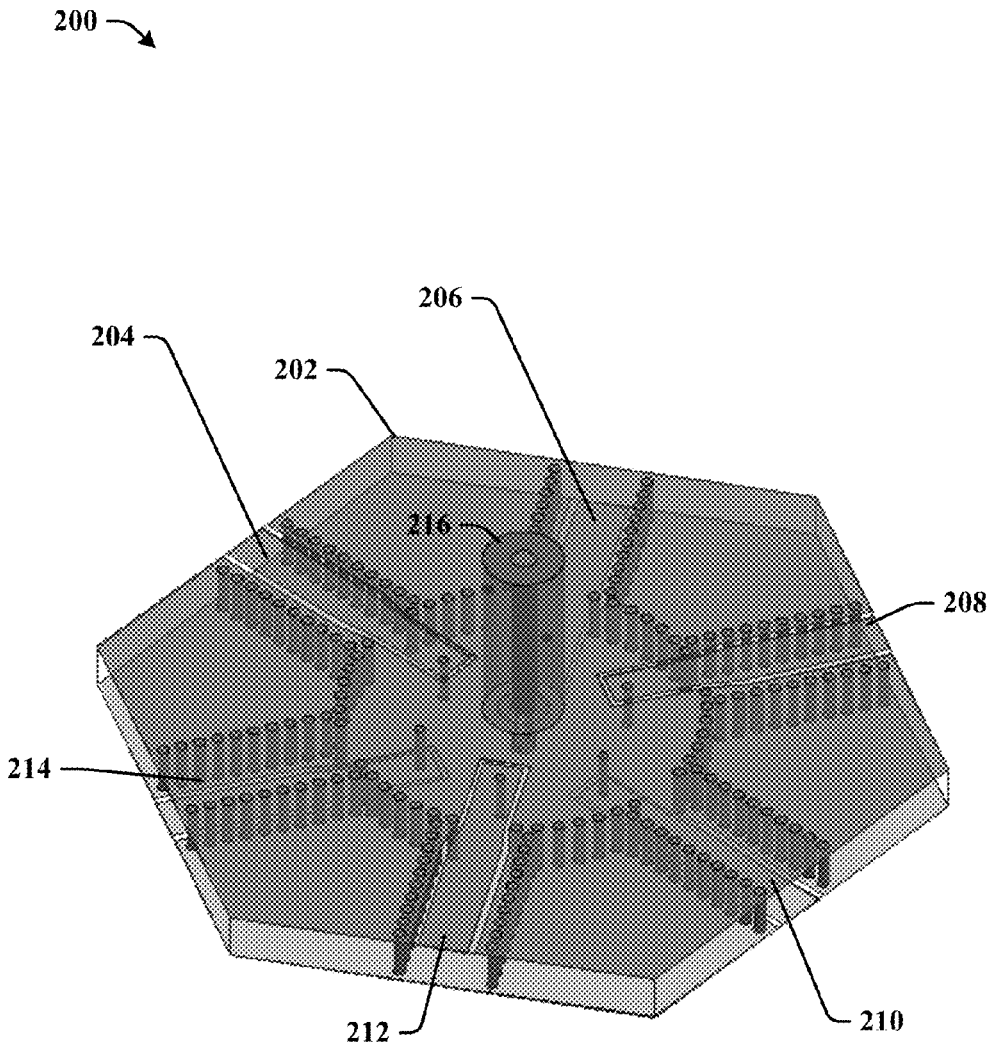
FIG. 2 illustrates an example, non-limiting embodiment of a power divider/combiner with reversed ports in accordance with the subject disclosure.

Turning now to FIG. 2, illustrated is an example, non-limiting embodiment 200 of a power divider/combiner 202 with reversed ports in accordance with the subject disclosure. In FIG. 2, power divider/combiner 202 has six ports for probe outputs (e.g., ports 204, 206, 208, 210, 212, and 214. Unlike in the embodiments described above, the probe outputs are reversed on a set of the ports. Ports 204, 208 and 212 have probe outputs at one orientation/polarity, while ports 206, 210, and 214 have probe outputs that are reversed. In an embodiment, the orientation and/or polarity of the probe outputs is based on the side of the dielectric substrate that the metallic microstrips are printed on. Transmissions that couple to ports 204, 208, and 212 will be 180 degrees out of phase from transmissions that couple to ports 206, 210, and 214.

Depending on the transmission and/or the orientation of the coaxial common port 216 relative to the ports, transmissions entering coaxial common port 216 will couple to one of the sets of ports, while coupling to the other set of ports at a reversed phase. If the orientation of the coaxial common port 216 or the power divider and combiner 202 is changed, the phase of the transmission can switch.

Figure 3:
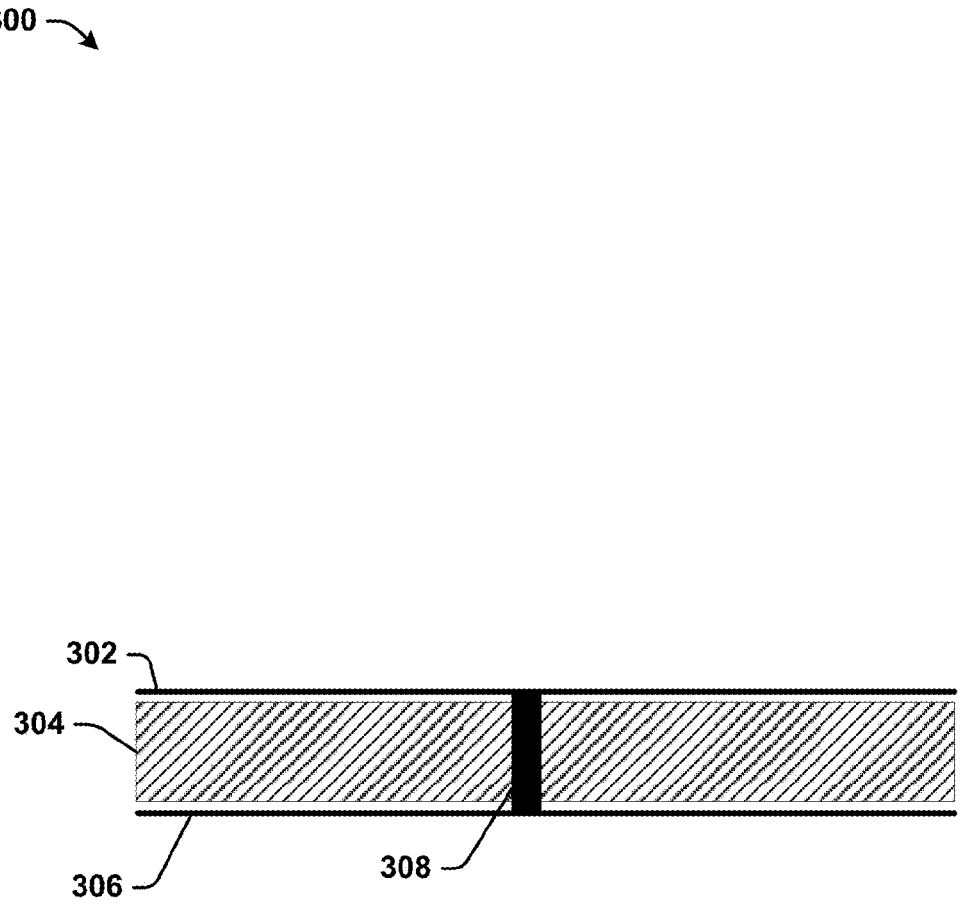
FIG. 3 illustrates an example, non-limiting embodiment of a power divider/combiner with a dielectric substrate sandwiched between two metal plates in accordance with the subject disclosure.

Turning now to FIG. 3, illustrated is an example, non-limiting embodiment of a power divider/combiner 300 with a dielectric substrate 304 sandwiched between two metal plates 302 and 306 in accordance with the subject disclosure. A series of metal connectors (e.g., metal connector 308) can be formed between the metal plates 302 and 306 to link them and form a cavity within which pass the microwave and/or millimeter wave transmissions.

In an embodiment, the dielectric substrate 304 can be formed from a substrate board using printed circuit technology. In an embodiment, the dielectric substrate 304 can have a dielectric constant between 2.2 and 2.4, and have a thickness between about 1.5 mm and about 1.7 mm, and have a dielectric loss tangent between about 0.001 and 0.002. At a tested embodiment, a dielectric constant value of 2.33, a thickness of 1.57 mm, and dielectric loss tangent of 0.0012 was found to produce high efficiency transfers, with low insertion loss over a broad bandwidth.

Figure 4A:
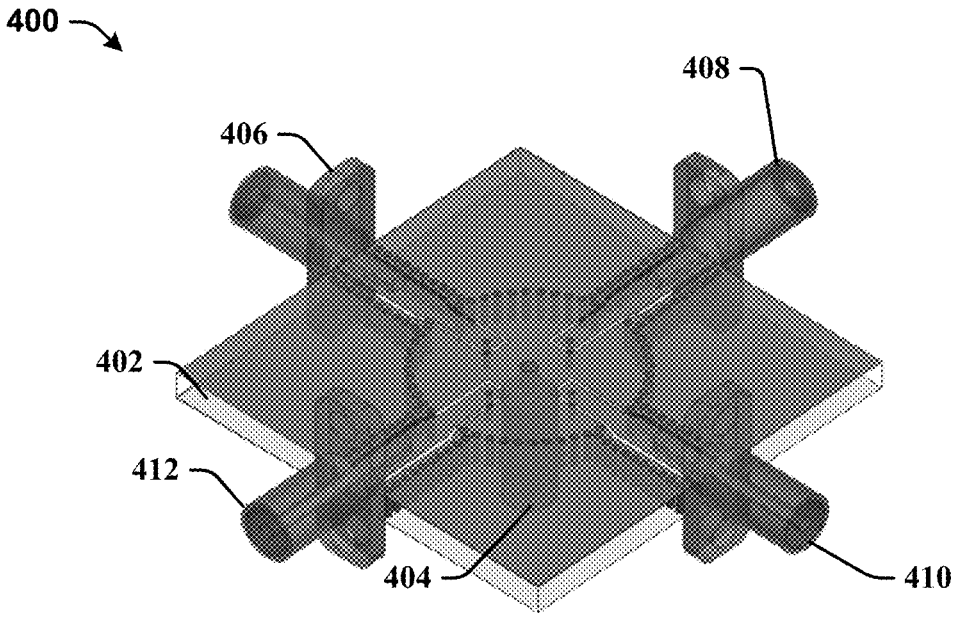
FIG. 4A illustrates an example, non-limiting embodiment of a 4-way power divider/combiner in accordance with the subject disclosure.

Turning now to FIG. 4A, illustrated is an example, non-limiting embodiment of a 4-way power divider/combiner 400 in accordance with the subject disclosure. Power divider/combiner 400 can have four ports (ports 406, 408, 410, and 412), equally spaced around the power divider/combiner 400. The ports can have SMA (SubMiniature version A) connectors that are coupled the probe outputs and allow coaxial RF transmission lines to be coupled to each of the ports 406, 408, 410, and 412. In an embodiment, grounded coplanar waveguide (GCPW) is used as the outside transmission line for each of the ports.

Power divider/combiner 400 can comprise a dielectric substrate 402 that has a dielectric constant between 2.2 and 2.4, and have a thickness between about 1.5 mm and about 1.7 mm, and have a dielectric loss tangent between about 0.001 and 0.002.

A transmission entering via coaxial common port 404 can couple to each of the four grounded coplanar waveguides associated with the ports and is passed through the four probe output ports and is transmitted out to transmission lines coupled to the probe outputs with a concomitant decrease in power that is based on a function of the number of probe outputs, in this case, four. In this embodiment shown in FIG. 4A, all of the probes are on the same side of the cavity, and so the transmission couples equally to all of the ports at the same phase. In other embodiments (see FIG. 5A), the probes can be reversed, providing out of phase coupling.

Figure 4B:
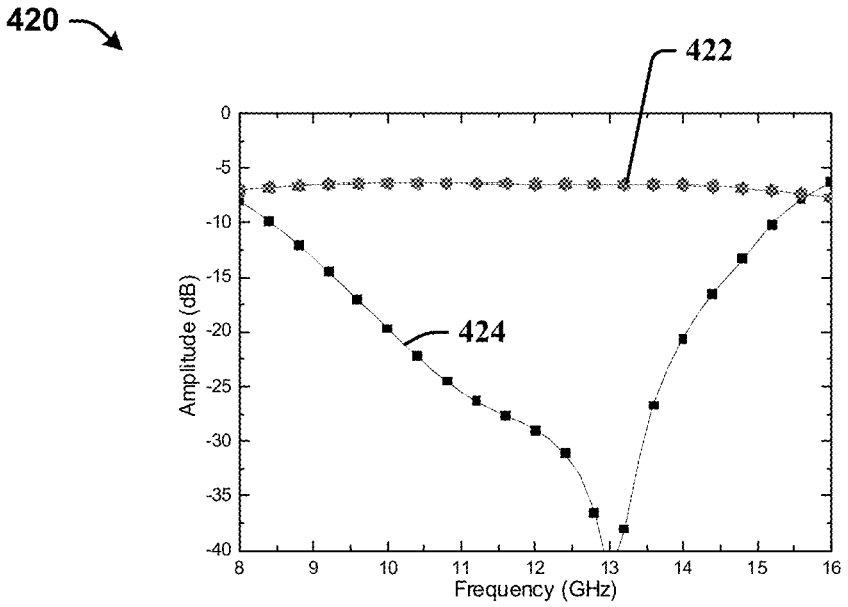
FIG. 4B illustrates a chart showing performance of the 4-way power divider/combiner in accordance with the subject disclosure.

Turning now to FIG. 4B, illustrated is a chart 420 showing performance of the 4-way power divider/combiner in accordance with the subject disclosure. The 4 way power divider/combiner was tested between in the frequency range between 9.28-14.6 GHz. The $S_{11}$ (reflection coefficient) 424 remains below −15 dB within the frequency range, and the insertion loss 422 is better than −6.7 dB throughout the frequency range.

Figure 5A:
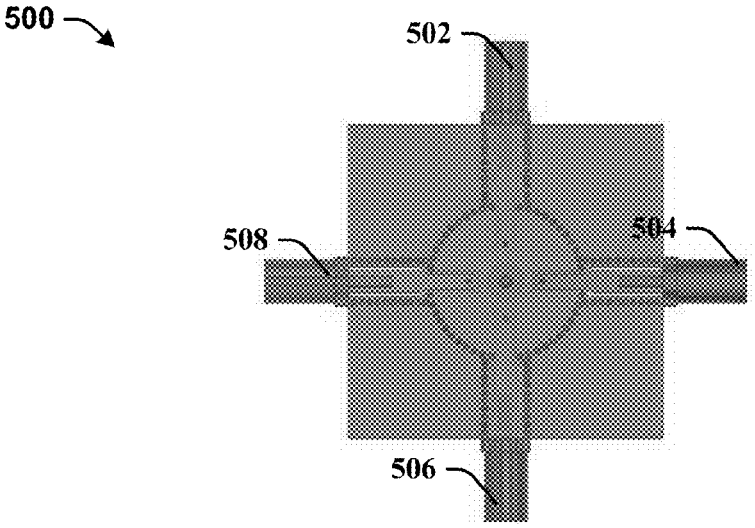
FIG. 5A illustrates an example, non-limiting embodiment of a 4-way power divider/combiner with a set of reversed ports in accordance with the subject disclosure.

Turning now to FIG. 5A, illustrated is an example, non-limiting embodiment of a 4-way power divider/combiner 500 with a set of reversed ports in accordance with the subject disclosure. Power divider/combiner 500 can have four ports (ports 502, 504, 506, and 508), equally spaced around the power divider/combiner 400. The ports can have SMA connectors that are coupled the probe outputs and allow coaxial RF transmission lines to be coupled to each of the ports 502, 504, 506, and 508). Ports 502 and 506 have probe outputs at one orientation/polarity, while ports 504 and 508 have probe outputs that are reversed. In an embodiment, the orientation and/or polarity of the probe outputs is based on the side of the dielectric substrate that the metallic microstrips are printed on. In an embodiment, grounded coplanar waveguide (GCPW) is used as the outside transmission line for each of the ports.

Depending on the transmission and/or the orientation of the coaxial common port relative to the ports, transmissions entering the coaxial common port will couple to one of the sets of ports at a certain phase, while coupling to the other set of ports at a completely reversed phase. Thus, the power divider/combiner 500 still acts a 4 way divider, but the phase of two of the output ports are completely reversed from the phase output of the other. If the orientation of the coaxial common port or the power divider/combiner 500 is changed, the phase of the transmission that couples to the ports can also change.

Figure 5B:
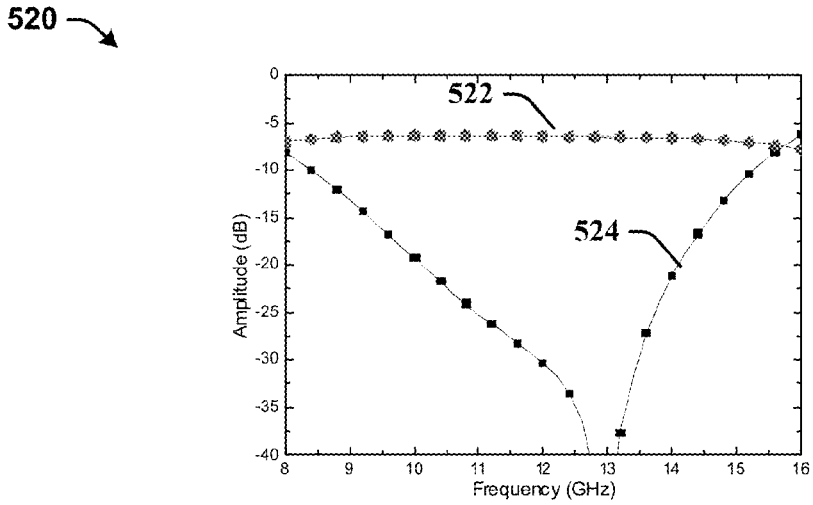
FIG. 5B illustrates a chart showing performance of the 4-way power divider/combiner with a set of reversed ports in accordance with the subject disclosure.

Turning now to FIG. 5B, illustrated is a chart 520 showing performance of the 4-way power divider/combiner with a set of reversed ports in accordance with the subject disclosure. The 4 way power divider/combiner was tested between in the frequency range between 9.3-14.6 GHz. The insertion loss remains low throughout the frequency range. The $S_{11}$ (reflection coefficient) 524 remains below −15 dB within the frequency range, and the insertion loss 522 is better than −6.72 dB throughout the frequency range.

Figure 5C:
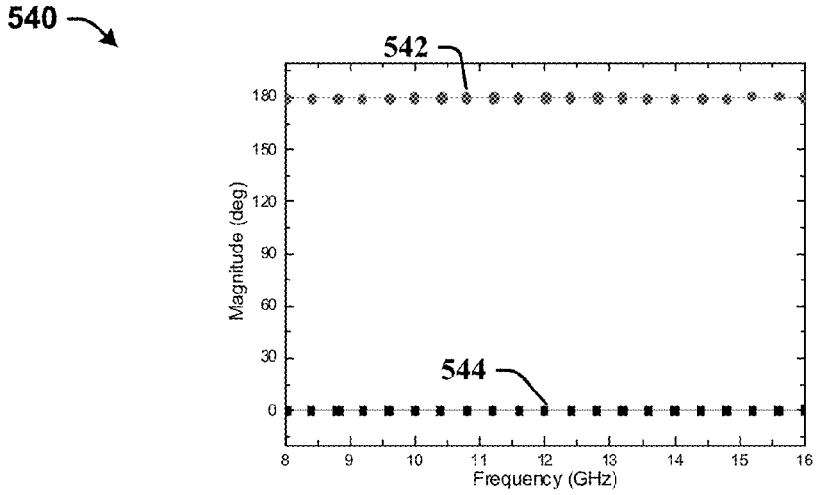
FIG. 5C illustrates a chart showing performance of the 4-way power divider/combiner with a set of reversed ports in accordance with the subject disclosure.

Turning now to FIG. 5C, illustrated is a chart 540 showing performance of the 4-way power divider/combiner with a set of reversed ports in accordance with the subject disclosure. Line 542 represents the magnitude of the transmission being transmitted through one of the sets of ports, while line 544 represents the phase magnitude of the transmission being sent through the reversed port. This graph shows that the reversed probe outputs are completely 180 degrees out of phase from the other set of ports. In particular, at a particular time, the phase difference of a transmission sent through a first set of ports (e.g, ports 502 and 506) is zero as shown at line 544. By contrast, at the same time, the phase difference of a transmission sent through a second set of ports (e.g., ports 504 and 508) is 180 degrees as shown at line 542.

Figure 6A:
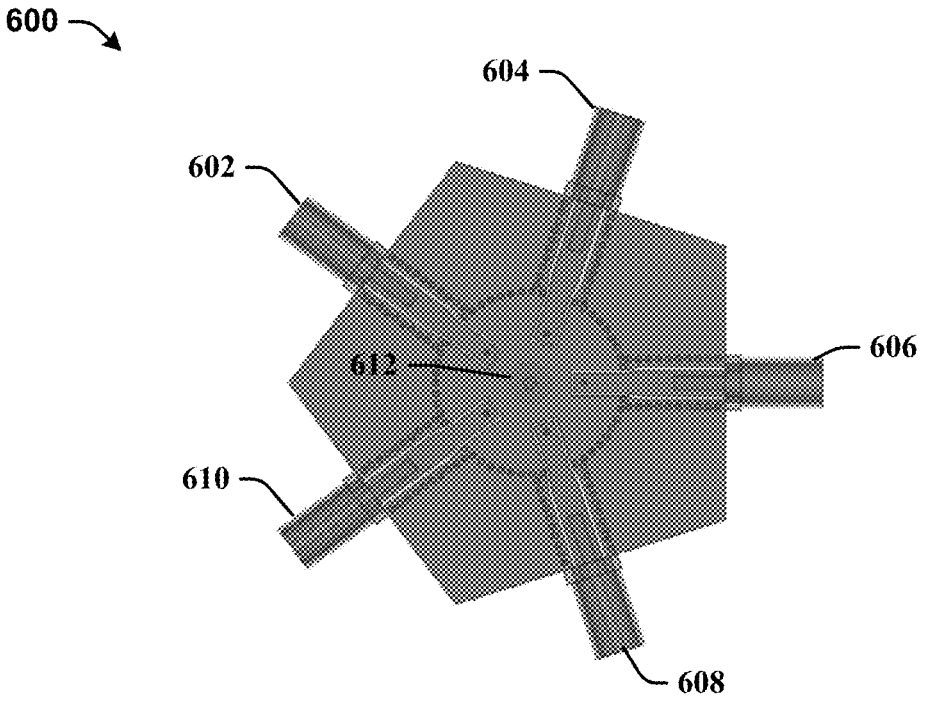
FIG. 6A illustrates an example, non-limiting embodiment of a 5-way power divider/combiner in accordance with the subject disclosure.

Turning now to FIG. 6A, illustrated is an example, non-limiting embodiment of a 5-way power divider/combiner in accordance with the subject disclosure. Power divider/combiner 600 can have five ports (ports 602, 604, 606, 608, and 610), equally spaced around the power divider/combiner 600. The ports can have SMA connectors that are coupled the probe outputs and allow coaxial RF transmission lines to be coupled to each of the ports 602, 604, 606, 608, and 610. In an embodiment, grounded coplanar waveguide (GCPW) is used as the outside transmission line for each of the ports.

Power divider/combiner 600 can comprise a dielectric substrate that has a dielectric constant between 2.2 and 2.4, and have a thickness between about 1.5 mm and about 1.7 mm, and have a dielectric loss tangent between about 0.001 and 0.002.

A transmission entering via coaxial common port 612 can couple to each of the five grounded coplanar waveguides associated with the ports and is passed through the five probe output ports and is transmitted out to transmission lines coupled to the probe outputs with a decrease in power that is based on a function of the number of probe outputs, in this case, five. In this embodiment shown in FIG. 6A, all of the probes are on the same side of the cavity, and so the transmission couples equally to all of the ports at the same phase.

Figure 6B:
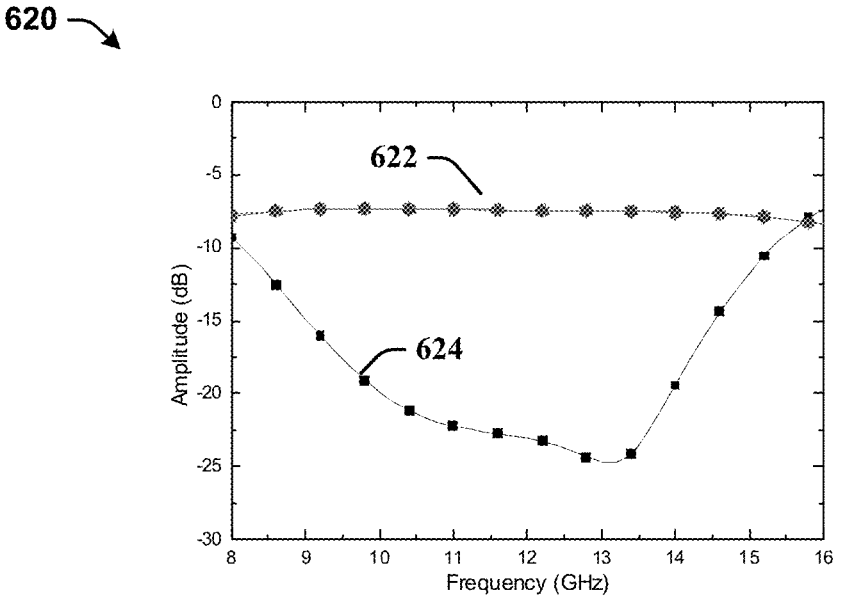
FIG. 6B illustrates a chart showing performance of the 5-way power divider/combiner in accordance with the subject disclosure.

Referring now to FIG. 6B, illustrated is a chart showing performance of the 5-way power divider/combiner in accordance with the subject disclosure. The 5-way power divider/combiner was tested between in the frequency range between 9.02-14.52 GHz. The insertion loss remains low throughout the frequency range. The $S_{11}$ (reflection coefficient) 624 remains below −15 dB within the frequency range, and the forward gain 622 is better than −7.6 dB throughout the frequency range.

Figure 7A:
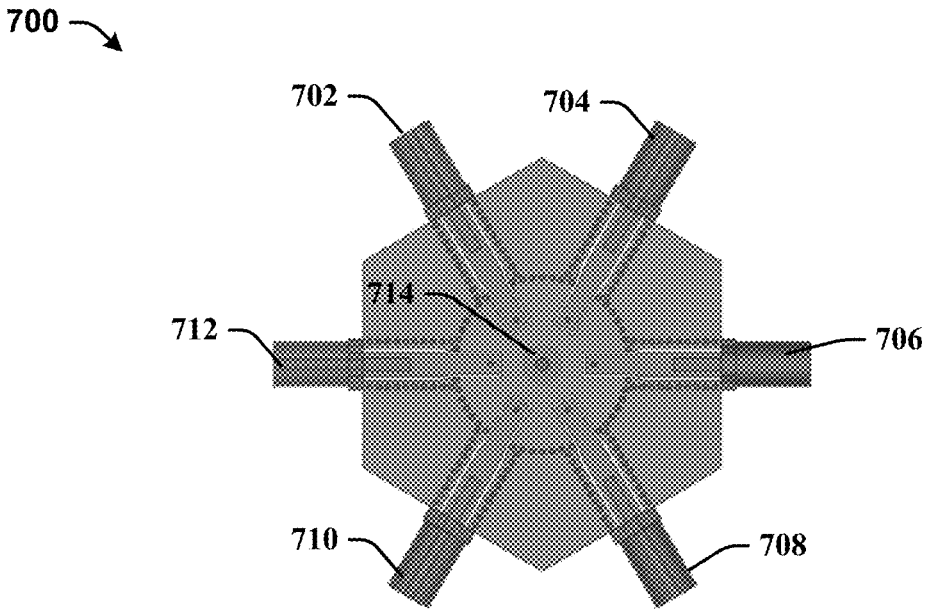
FIG. 7A illustrates an example, non-limiting embodiment of a 6-way power divider/combiner in accordance with the subject disclosure.

Turning now to FIG. 7A, illustrated is an example, non-limiting embodiment of a 6-way power divider/combiner in accordance with the subject disclosure. Power divider/combiner 700 can have six ports (ports 702, 704, 706, 708, 710, and 712), equally spaced around the power divider/combiner 700. The ports can have SMA that are coupled the probe outputs and allow coaxial RF transmission lines to be coupled to each of the ports 702, 704, 706, 708, 710, and 712. In an embodiment, grounded coplanar waveguide (GCPW) is used as the outside transmission line for each of the ports.

Power divider/combiner 700 can comprise a dielectric substrate that has a dielectric constant between 2.2 and 2.4, and have a thickness between about 1.5 mm and about 1.7 mm, and have a dielectric loss tangent between about 0.001 and 0.002.

A transmission entering via coaxial common port 714 can couple to each of the six waveguides associated with the ports and is passed through the six probe output ports and is transmitted out to transmission lines coupled to the probe outputs with a decrease in power that is based on a function of the number of probe outputs, in this case, six. In this embodiment shown in FIG. 7A, all of the probes are on the same side of the cavity, and so the transmission couples equally to all of the ports at the same phase.

Figure 7B:
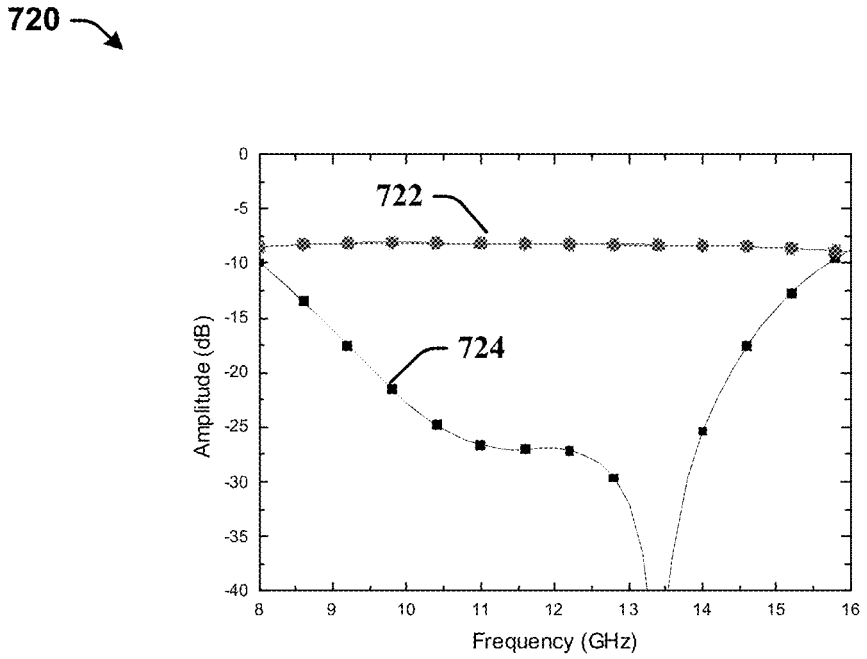
FIG. 7B illustrates a chart showing performance of the 6-way power divider/combiner in accordance with the subject disclosure.

Referring now to FIG. 7B, illustrated is a chart showing performance of the 6-way power divider/combiner in accordance with the subject disclosure. The 6-way power divider/combiner was tested between in the frequency range between 8.83-14.9 GHz. The insertion loss remains low throughout the frequency range. The $S_{11}$ (reflection coefficient) 724 remains below −15 dB within the frequency range, and the insertion loss 722 is better than −8.5 dB throughout the frequency range.

Figure 8A:
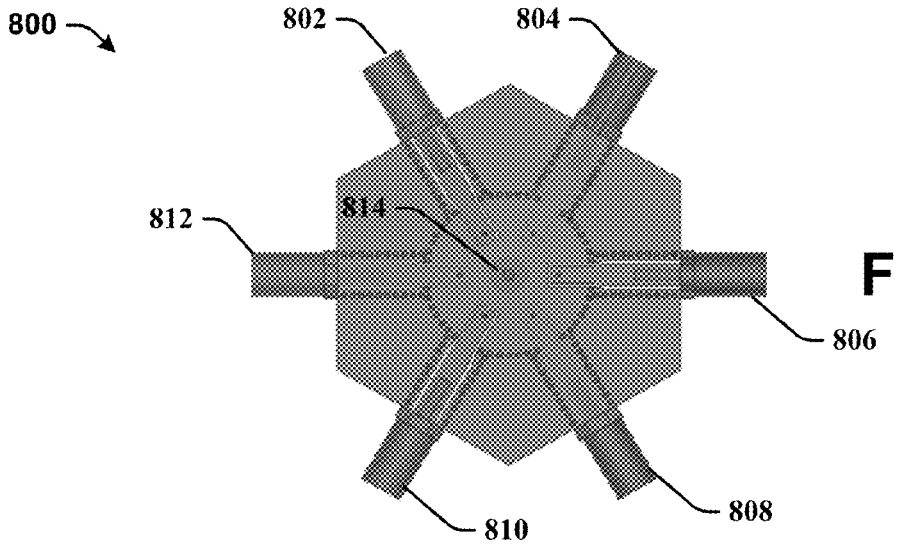
FIG. 8A illustrates an example, non-limiting embodiment of a 6-way power divider/combiner with a set of reversed ports in accordance with the subject disclosure.

Turning now to FIG. 8A, illustrated is an example, non-limiting embodiment of a 6-way power divider/combiner 800 with a set of reversed ports in accordance with the subject disclosure. Power divider/combiner 800 can have six ports (ports 802, 804, 806, 808, 810, and 812), equally spaced around the power divider/combiner 800. The ports can have SMA connectors that are coupled the probe outputs and allow coaxial RF transmission lines to be coupled to each of the ports 802, 804, 806, 808, 810, and 812). Ports 802, 806, and 810 have probe outputs at one orientation, while ports 804, 808, and 812 have probe outputs that are reversed. In an embodiment, the orientation and/or polarity of the probe outputs is based on the side of the dielectric substrate that the metallic microstrips are printed on. In an embodiment, grounded coplanar waveguide (GCPW) is used as the outside transmission line for each of the ports.

Depending on the transmission and/or the orientation of the coaxial common port relative to the ports, transmissions entering the coaxial common port will couple to one of the sets of ports at a certain phase, while coupling to the other set of ports at a completely reversed phase. Thus, the power divider/combiner 800 still acts a 6 way divider, but the phase output of three of the ports are completely reversed from the phase output of the other three. If the orientation of the coaxial common port or the power divider/combiner 800 is changed, the phase of the transmission that couples to the ports can also change.

Figure 8B:
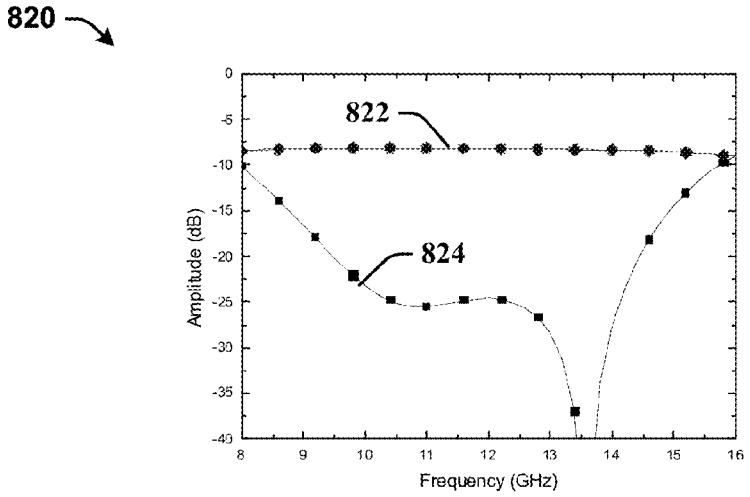
FIG. 8B illustrates a chart showing performance of the 6-way power divider/combiner with a set of reversed ports in accordance with the subject disclosure.

Turning now to FIG. 8B, illustrated is a chart 820 showing performance of the 6-way power divider/combiner with a set of reversed ports in accordance with the subject disclosure. The 6-way power divider/combiner was tested between in the frequency range between 8.83-14.9 GHz. The insertion loss remains low throughout the frequency range. The $S_{11}$ (reflection coefficient) 824 remains below −15 dB within the frequency range, and the insertion loss 822 is better than −8.5 dB throughout the frequency range.

Figure 8C:
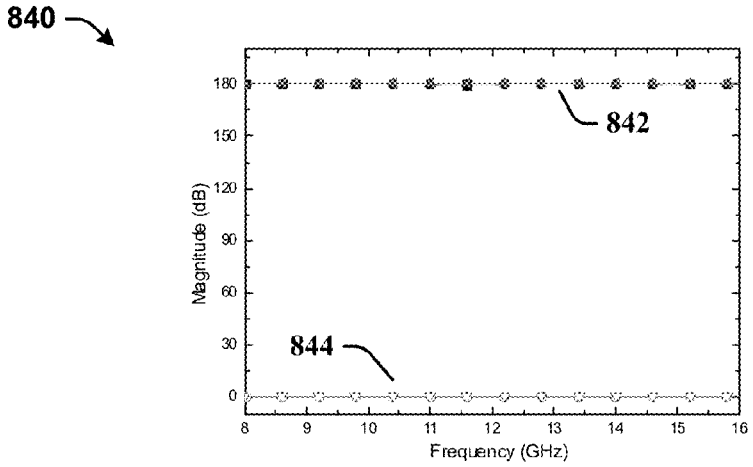
FIG. 8C illustrates a chart showing performance of the 6-way power divider/combiner with a set of reversed ports in accordance with the subject disclosure.

Turning now to FIG. 8C, illustrated is a chart 840 showing performance of the 6-way power divider/combiner with a set of reversed ports in accordance with the subject disclosure.

Line 842 represents the phase difference of the transmission being transmitted through one of the sets of ports, while line 844 represents the phase difference of the transmission being sent through the reversed ports. This graph shows that the reversed probe outputs are completely 180 degrees out of phase from the other set of ports. In particular, at a particular time, the phase difference of a transmission sent through a first set of ports (e.g, ports 802, 806, and 810) is zero as shown at line 844. By contrast, at the same time, the phase difference of a transmission sent through a second set of ports (e.g., ports 804, 808, and 812) is 180 degrees as shown at line 842.

Figure 9A:
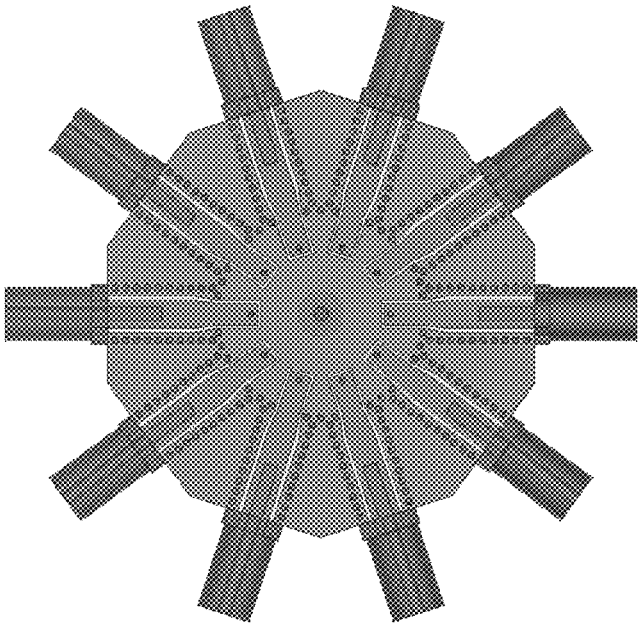
FIG. 9A illustrates an example, non-limiting embodiment of a 10-way power divider/combiner in accordance with the subject disclosure.

Turning now to FIG. 9A, illustrated is an example, non-limiting embodiment of a 10-way power divider/combiner 900 in accordance with the subject disclosure. Power divider/combiner 900 can have ten ports equally spaced around the power divider/combiner 900. The ports can have SMA connectors that are coupled the probe outputs and allow coaxial RF transmission lines to be coupled to each of the ports. In an embodiment, grounded coplanar waveguide (GCPW) is used as the outside transmission line for each of the ports.

Power divider/combiner 900 can comprise a dielectric substrate that has a dielectric constant between 2.2 and 2.4, and have a thickness between about 1.5 mm and about 1.7 mm, and have a dielectric loss tangent between about 0.001 and 0.002.

A transmission entering via a coaxial common port can couple to each of the ten grounded coplanar waveguides associated with the ports and is passed through the ten probe output ports and is transmitted out to transmission lines coupled to the probe outputs with a decrease in power that is based on a function of the number of probe outputs, in this case, ten. In this embodiment shown in FIG. 9A, all of the probes are on the same side of the cavity, and so the transmission couples equally to all of the ports at the same phase.

Figure 9B:
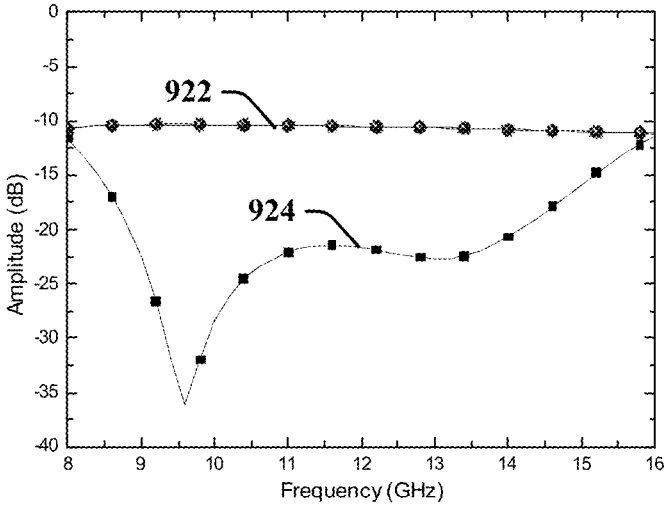
FIG. 9B illustrates a chart showing performance of the 10-way power divider/combiner in accordance with the subject disclosure.

Referring now to FIG. 9B, illustrated is a chart showing performance of the 10-way power divider/combiner in accordance with the subject disclosure. The 10-way power divider/combiner was tested between in the frequency range between 8.4-15.1 GHz. The insertion loss remains low throughout the frequency range. The $S_{11}$ (reflection coefficient) 924 remains below −15 dB within the frequency range, and the insertion loss 922 is better than −11 dB throughout the frequency range.

Figure 10A:
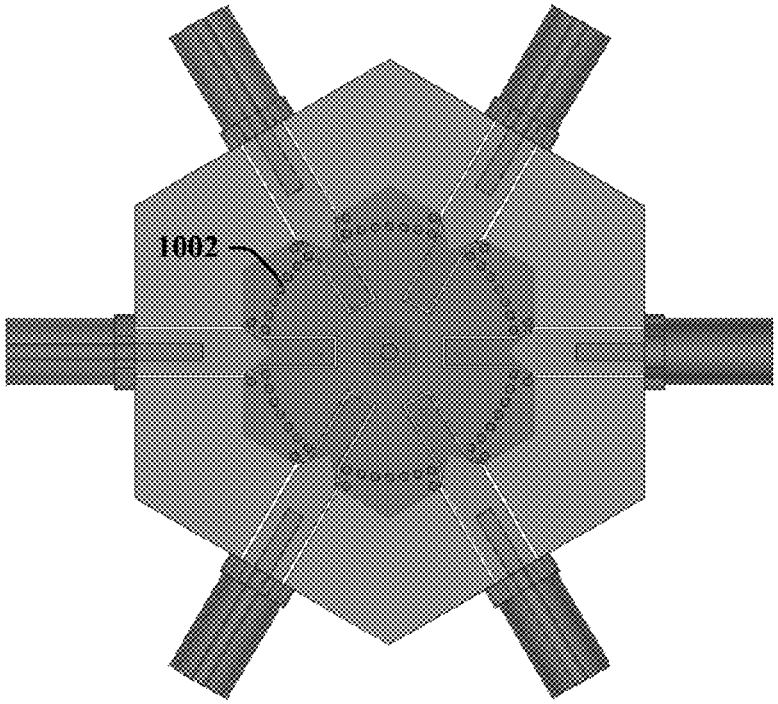
FIG. 10A illustrates an example, non-limiting embodiment of a 6-way power divider/combiner with a coplanar waveguide in accordance with the subject disclosure.

Turning now to FIG. 10A illustrated is an example, non-limiting embodiment of a 6-way power divider/combiner with a coplanar waveguide in accordance with the subject disclosure. Power divider/combiner 1000 can have six ports equally spaced around the power divider and combiner 1000. The ports can have SMA connectors that are coupled the probe outputs and allow coaxial RF transmission lines to be coupled to each of the ports. In an embodiment, coplanar waveguide (CPW) instead of GCPW is used as the outside transmission line for each of the ports.

Power divider/combiner 1000 can comprise a dielectric substrate that has a dielectric constant between 2.2 and 2.4, and have a thickness between about 1.5 mm and about 1.7 mm, and have a dielectric loss tangent between about 0.001 and 0.002.

A transmission entering via a coaxial common port can couple to each of the six coplanar waveguides associated with the ports and is passed through the six probe output ports and is transmitted out to transmission lines coupled to the probe outputs with a decrease in power that is based on a function of the number of probe outputs, in this case, six. In this embodiment shown in FIG. 10A, all of the probes are on the same side of the cavity, and so the transmission couples equally to all of the ports at the same phase.

Figure 10B:
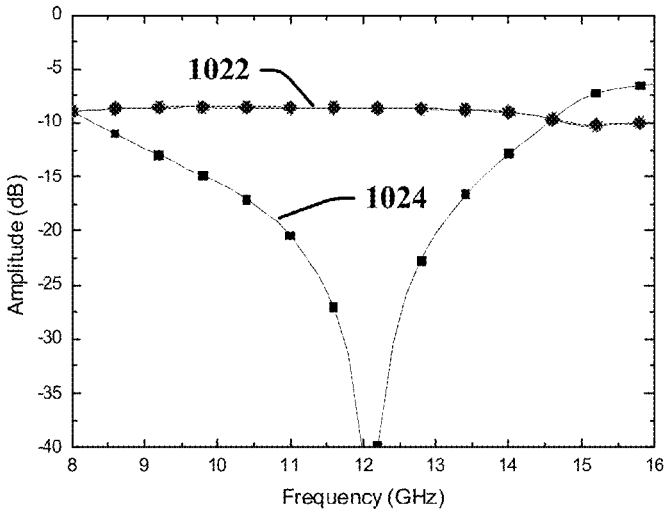
FIG. 10B illustrates a chart showing performance of the 6-way power divider/combiner with a coplanar waveguide in accordance with the subject disclosure.

Referring now to FIG. 10B, illustrated is a chart showing performance of the 6-way power divider/combiner with a coplanar waveguide in accordance with the subject disclosure. The 6-way power divider/combiner was tested between in the frequency range between 9.85-13.63 GHz. The insertion loss remains low throughout the frequency range. The $S_{11}$ (reflection coefficient) 1024 remains below −15 dB within the frequency range, and the insertion loss 1022 is better than −8.85 dB throughout the frequency range. The insertion loss is worse than the embodiment of the 6-way combiner/divider shown in FIGS. 7A and 7B since the loss associated with CPW is higher than the loss associated with GCPW.

It is to be appreciated that while references in the figures have been made to N-Way power dividers/combiners with 4, 5, 6, and 10 outputs and primarily to GCPW, in other embodiments, any number of outputs are possible in either GCPW or CPW. The exemplary embodiments shown in the figures are merely exemplary, and non-limiting.

Figure 11:
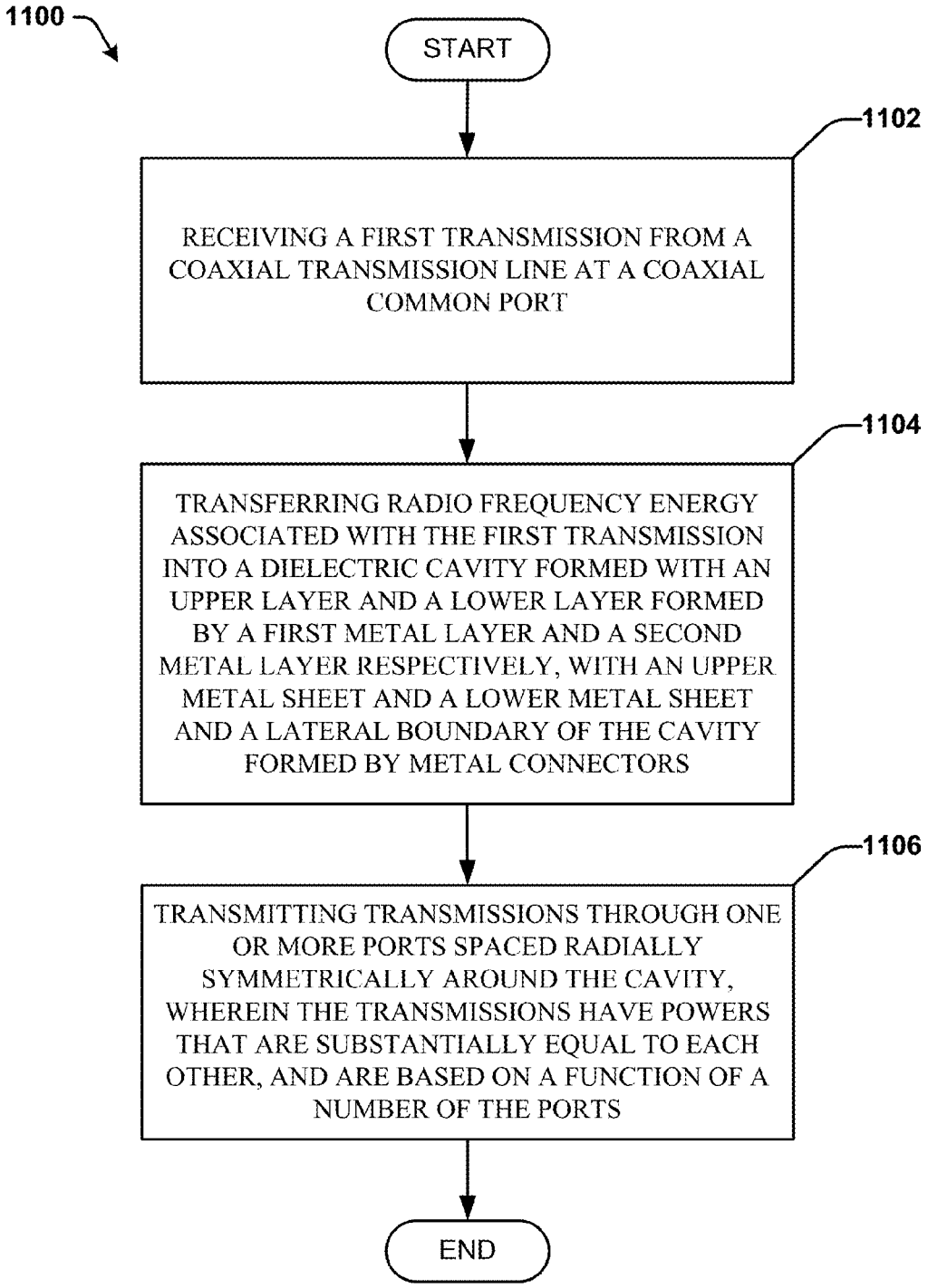
FIG. 11 illustrates an example, non-limiting method for splitting power in accordance with the subject disclosure.
Figure 12:
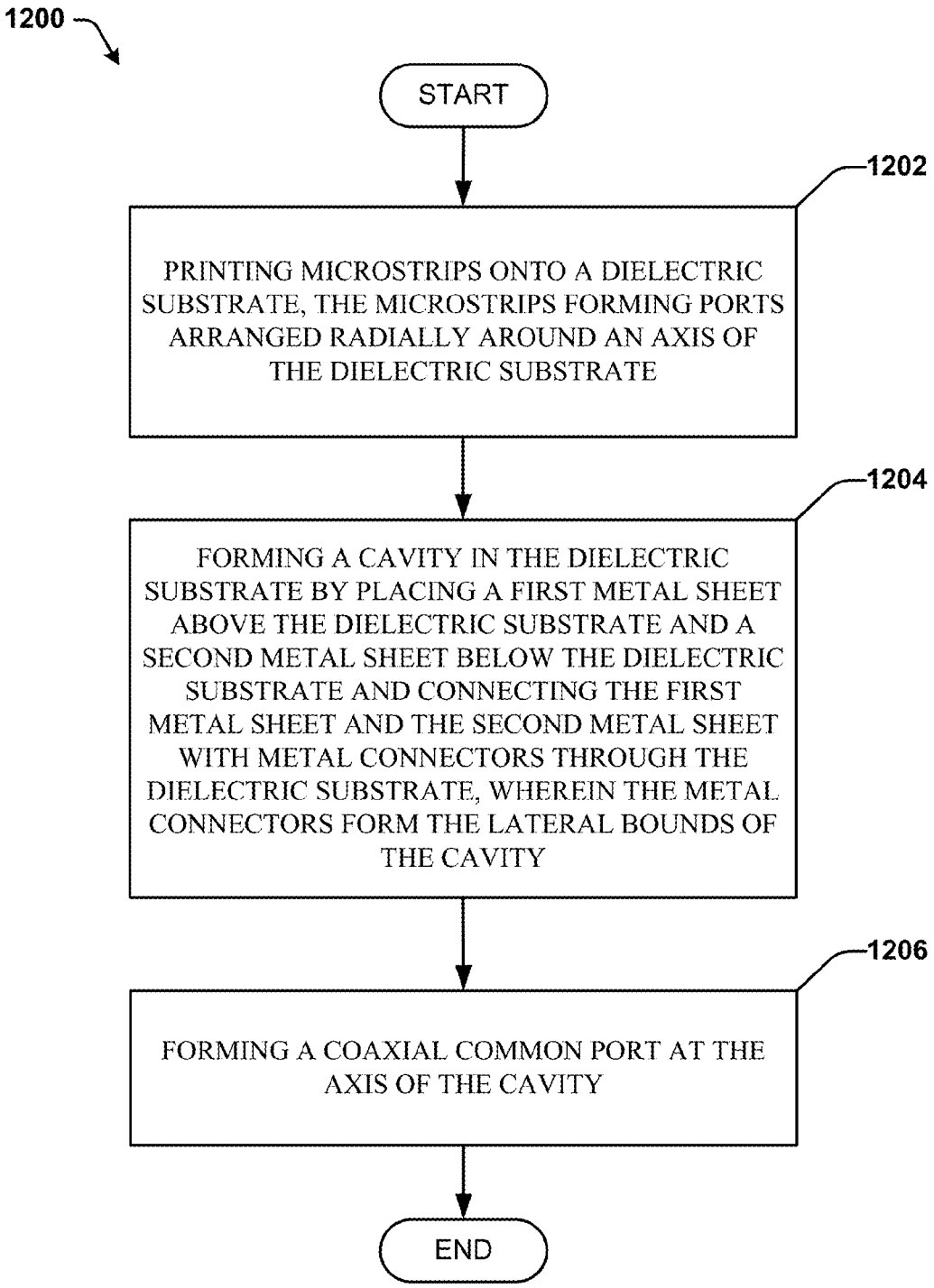
FIG. 12 illustrates an example, non-limiting method for fabricating a power divider/combiner in accordance with the subject disclosure.

FIGS. 11-12 illustrate processes in connection with the aforementioned systems. The process in FIG. 11-12 can be implemented for example by the embodiments shown in FIGS. 1A, 2, 3, 4A, 5A, 6A, 7A, 8A, 9A, and 10A. While for purposes of simplicity of explanation, the methods are shown and described as a series of blocks, it is to be understood and appreciated that the claimed subject matter is not limited by the order of the blocks, as some blocks may occur in different orders and/or concurrently with other blocks from what is depicted and described herein. Moreover, not all illustrated blocks may be required to implement the methods described hereinafter.

FIG. 11 illustrates an example, non-limiting method 1100 for splitting power in accordance with the subject disclosure. The method can begin at step 1102 where a first transmission is received from a coaxial transmission line at a coaxial common port. The coaxial common port can be placed on a power divider/combiner such that is on the radial axis of a dielectric substrate. In an embodiment, the dielectric substrate can have a metal sheet above the dielectric substrate and another metal sheet below the dielectric substrate. It is to be appreciated that in other some embodiments, the metal sheets can be made out of partially metallic or otherwise non metallic conductors. Connecting the metal sheets can be a plurality of metal posts or metallic slots that connect the metal sheets through the dielectric substrate. It is to be appreciated that in other embodiments, metal wires, or other conducting materials can be used to connect the metal sheets. The metal posts and the metal sheets and form the bounds of the cavity within which pass the microwave and/or millimeter wave transmissions.

At step 1104 radio frequency energy associated with a first transmission can be transferred into a dielectric cavity formed with an upper layer and a lower layer formed by the first metal layer and the second metal layer respectively, with an upper metal sheet and a lower metal sheet and a lateral boundary of the cavity formed by the metal connectors.

At 1106, transmissions can be transmitted through one or more ports spaced radially symmetrically around the cavity, wherein the transmissions have powers that are substantially equal to each other, and are based on a function of a number of the ports. The power output can be a based on a function of the number of probe outputs, the input power and the amount of loss sustained in the splitting of the power.

In another embodiment, one or more transmissions can enter through one or more of the probe output/inputs and be combined with the other transmissions which then collectively couple to the coaxial common port and are emitted as a combined transmission.

FIG. 12 illustrates an example, non-limiting method 1200 for fabricating a power divider/combiner in accordance with the subject disclosure. At 1202, the method includes printing microstrips onto a dielectric substrate, the microstrips forming ports arranged radially around an axis of the dielectric substrate.

At 1204, the method includes forming a cavity in the dielectric substrate by placing a first metal sheet above the dielectric substrate and a second metal sheet below the dielectric substrate and connecting the first metal sheet and the second metal sheet with metal connectors through the dielectric substrate, wherein the metal connectors form the lateral bounds of the cavity. At 1206, the method includes forming a coaxial common port at the axis of the cavity.

It is to be appreciated that while reference is generally made throughout the specification to the power divider/combiners splitting/dividing incoming transmissions, the power divider/combiners can also combine transmissions. Transmission entering through one or more of the N way probe outputs can be combined and transmitted out via the coaxial common port.

Reference throughout this specification to "one embodiment," or "an embodiment," means that a particular feature, structure, or characteristic described in connection with the embodiment is included in at least one embodiment. Thus, the appearances of the phrase "in one embodiment," "in one aspect," or "in an embodiment," in various places throughout this specification are not necessarily all referring to the same embodiment. Furthermore, the particular features, structures, or characteristics may be combined in any suitable manner in one or more embodiments.

Further, these components can execute from various computer readable media having various data structures stored thereon. The components can communicate via local and/or remote processes such as in accordance with a signal having one or more data packets (e.g., data from one component interacting with another component in a local system, distributed system, and/or across a network, e.g., the Internet, a local area network, a wide area network, etc. with other systems via the signal).

As another example, a component can be an apparatus with specific functionality provided by mechanical parts operated by electric or electronic circuitry; the electric or electronic circuitry can be operated by a software application or a firmware application executed by one or more processors; the one or more processors can be internal or external to the apparatus and can execute at least a part of the software or firmware application. As yet another example, a component can be an apparatus that provides specific functionality through electronic components without mechanical parts; the electronic components can include one or more processors therein to execute software and/or firmware that confer(s), at least in part, the functionality of the electronic components. In an aspect, a component can emulate an electronic component via a virtual machine, e.g., within a cloud computing system.

The words "exemplary" and/or "demonstrative" are used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, such terms are intended to be inclusive—in a manner similar to the term "comprising" as an open transition word—without precluding any additional or other elements.

The herein described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the subject disclosure have been described herein for purposes of illustration, and that various modifications may be made without departing from the scope and spirit of the subject disclosure. Accordingly, the various embodiments disclosed herein are not intended to be limiting, with the true scope and spirit being indicated by the following claims.

What is claimed is:

1. A power divider/combiner, comprising:

a dielectric substrate between an upper metal sheet and a lower metal sheet;

metal connectors that link the upper metal sheet and the lower metal sheet forming a cavity within the dielectric substrate with ports formed in the cavity, wherein the ports are substantially radially symmetrical around a circumference of the cavity; and a coaxial common port that is formed in an axis of the cavity, perpendicular to the ports, wherein a transmission received at the coaxial common port is transmittable to the ports based on an orientation of probes associated with the ports.

2. The power divider/combiner of claim 1, wherein the ports are communicably coupled to peripheral transmission lines.

3. The power divider/combiner of claim 2, wherein the peripheral transmission lines are grounded coplanar waveguides.

4. The power divider/combiner of claim 1, wherein the coaxial common port and the ports are connected to respective transmission lines via coaxial radio frequency connectors.

5. The power divider/combiner of claim 4, wherein an outside transmission line of the respective transmission lines is a grounded coplanar waveguide.

6. The power divider/combiner of claim 1, wherein a first power output level of the transmission at a port of the ports is decreased to a second power output level as the ports are increased from a first number of ports to a second number of ports, and wherein first power output level is lower than the second power output level and the second number of ports are greater than the first number of ports.

7. The power divider/combiner of claim 1, wherein the transmission received at the coaxial common port is transmitted to each of the ports in substantially equal portions in response to the probes of the ports having a shared orientation.

8. The power divider/combiner of claim 1, wherein the transmission received at the coaxial common port is transmitted to a first set of the ports at a first phase and to a second set of the ports in a second phase opposite the first phase in response to the probes of the first set of the ports and the second set of the ports having different orientations.

9. The power divider/combiner of claim 1, wherein the probes are printed on the dielectric substrate using microstrips printed on to a dielectric strip.

10. The power divider/combiner of claim 9, wherein the orientations of the probes are based on a side of the dielectric substrate on which the microstrips are printed.

11. The power divider/combiner of claim 1, wherein a size of the cavity and a spacing of the metal connectors are configured to transfer radio frequency energy.

12. The power divider/combiner of claim 1, wherein the metal connectors are metal posts.

13. The power divider/combiner of claim 1, wherein the metal connectors are rectangular metal slots.

14. A method for splitting power, comprising:

receiving a first transmission from a coaxial transmission line at a coaxial common port;

transferring radio frequency energy associated with the first transmission into a dielectric cavity formed with an upper layer and a lower layer formed by a first metal layer and a second metal layer respectively, with an upper metal sheet and a lower metal sheet and a lateral boundary of the cavity formed by metal connectors; and transmitting transmissions through one or more ports spaced radially symmetrically around the cavity, wherein the transmissions have powers that are substantially equal to each other, and are based on a function of a number of the one or more ports, and wherein the transmitting comprises transmitting a transmission received at the coaxial common port to the one or more ports based on an orientation of associated probes associated with the one or more ports.

15. The method for splitting power of claim 14, wherein the one or more ports comprise two or more ports, and wherein the transmitting further comprises:

transmitting equal portions to respective ports in response to the two or more ports having the associated probes that have a same orientation.

16. The method for splitting power of claim 14, wherein the one or more ports comprise two or more ports, and wherein the transmitting further comprises:

transmitting the transmission at a first phase through a first set of the two or more ports and transmitting the transmission at a second phase opposite the first phase through a second set of the two or more ports in response to the probes of the first set of the two or more ports and the second set of the two or more ports having different orientations.

17. A method for fabricating a power divider combiner, comprising:

printing microstrips onto a dielectric substrate, the microstrips forming ports arranged radially around a first axis of the dielectric substrate;

forming a cavity in the dielectric substrate by placing a first metal sheet above the dielectric substrate and a second metal sheet below the dielectric substrate and connecting the first metal sheet and the second metal sheet with metal connectors through the dielectric substrate, wherein the metal connectors form the lateral bounds of the cavity; and forming a coaxial common port at a second axis of the cavity.

18. The method for fabricating the power divider/combiner of claim 17, further comprising:

forming the ports symmetrically around the first axis, such that RF energy received at the coaxial common port is transferred equally to each of the ports.

19. The method for fabricating the power divider/combiner of claim 17, further comprising:

attaching coaxial radio frequency connectors to the ports.

20. The method for fabricating the power divider/combiner of claim 19, further comprising:

attaching grounded coplanar waveguide transmission lines to the coaxial radio frequency connectors.

* * * * *